US007900284B2

(12) United States Patent
Mazzarolo

(10) Patent No.: US 7,900,284 B2
(45) Date of Patent: Mar. 8, 2011

(54) GARMENT FOR SPORTING ACTIVITY

(75) Inventor: Giovanni Mazzarolo, Coste di Maser (IT)

(73) Assignee: Alpinestars Research SRL, Coste Di Maser (IT)

( * ) Notice: Subject to any disclaimer, the term of this patent is extended or adjusted under 35 U.S.C. 154(b) by 990 days.

(21) Appl. No.: 11/630,750

(22) PCT Filed: Nov. 18, 2004

(86) PCT No.: PCT/EP2004/013095
§ 371 (c)(1),
(2), (4) Date: Apr. 19, 2007

(87) PCT Pub. No.: WO2006/000249
PCT Pub. Date: Jan. 5, 2006

(65) Prior Publication Data

US 2008/0072367 A1 Mar. 27, 2008

(30) Foreign Application Priority Data

Jun. 24, 2004 (IT) ..... TV2004A0072

(51) Int. Cl.
*G21F 3/02* (2006.01)

(52) U.S. Cl. ..... 2/456; 2/461; 2/467; 602/19

(58) Field of Classification Search ..... 2/456, 2.15, 2/467, 461, 69, 94; 602/19
See application file for complete search history.

(56) References Cited

U.S. PATENT DOCUMENTS

| | | | | |
|---|---|---|---|---|
| 1,660,342 | A | | 2/1928 | Levinson |
| 3,086,214 | A | | 4/1963 | Lash |
| 3,329,966 | A | | 7/1967 | Slavick |
| 3,843,969 | A | * | 10/1974 | George et al. ..... 2/2.5 |
| 3,878,561 | A | | 4/1975 | Winiecki |
| 4,608,716 | A | | 9/1986 | Brumfield |
| 4,700,407 | A | | 10/1987 | Mattila |
| 4,722,099 | A | | 2/1988 | Kratz |
| 4,773,100 | A | | 9/1988 | Kuo |
| 4,810,559 | A | | 3/1989 | Fortier et al. |
| 4,841,577 | A | | 6/1989 | Lars-Jos |
| 4,845,778 | A | | 7/1989 | Peterson |
| 4,946,453 | A | | 8/1990 | Monson |
| 4,953,856 | A | | 9/1990 | Fox, III |
| 5,038,408 | A | | 8/1991 | DeBaene |
| 5,052,052 | A | | 10/1991 | Gilford et al. |

(Continued)

FOREIGN PATENT DOCUMENTS

DE 30 33 059 4/1982

(Continued)

OTHER PUBLICATIONS

International Search Report from the corresponding PCT/EP2004/013095.

(Continued)

*Primary Examiner* — Gary L Welch
*Assistant Examiner* — Alissa J Tompkins
(74) *Attorney, Agent, or Firm* — Katten Muchin Rosenman LLP

(57) ABSTRACT

Garment (10) for sporting activity, in particular a suit for motorcyclists, which is made of breathable fabric in selected regions and comprises a protective shield (40). At least the bottom portion (44) of the shield is removably inserted underneath a layer (58) of puckered elastic material fixed to the breathable fabric.

11 Claims, 2 Drawing Sheets

U.S. PATENT DOCUMENTS

| | | | | |
|---|---|---|---|---|
| 5,109,546 | A | 5/1992 | Dicker | |
| 5,201,074 | A | 4/1993 | Dicker | |
| 5,282,277 | A | 2/1994 | Onozawa | |
| 5,295,267 | A | 3/1994 | Galindo | |
| 5,337,418 | A | 8/1994 | Kato et al. | |
| 5,367,708 | A | 11/1994 | Fujimoto | |
| 5,402,539 | A * | 4/1995 | Hewitt | 2/227 |
| 5,649,328 | A | 7/1997 | Martin | |
| 5,652,957 | A | 8/1997 | Williford et al. | |
| 5,737,772 | A | 4/1998 | Dicker et al. | |
| 5,737,773 | A | 4/1998 | Dicker et al. | |
| 5,768,703 | A | 6/1998 | Machado et al. | |
| 5,845,335 | A | 12/1998 | Twitty | |
| 5,845,336 | A | 12/1998 | Golde | |
| 5,898,934 | A | 5/1999 | Hunter et al. | |
| 5,960,474 | A | 10/1999 | Dicker et al. | |
| 5,978,966 | A | 11/1999 | Dicker et al. | |
| 6,053,852 | A | 4/2000 | Wilkinson | |
| 6,176,816 | B1 | 1/2001 | Dicker et al. | |
| 6,186,970 | B1 | 2/2001 | Fujii et al. | |
| 6,260,196 | B1 | 7/2001 | van der Sleesen | |
| 6,279,161 | B1 | 8/2001 | Johnston | |
| 6,322,529 | B1 * | 11/2001 | Chung | 602/19 |
| 6,519,781 | B1 | 2/2003 | Berns | |
| D481,523 | S | 11/2003 | Hujii et al. | |
| 6,708,342 | B2 | 3/2004 | Boersema | |
| 6,745,400 | B1 * | 6/2004 | Paciorkowski | 2/69 |
| 6,817,029 | B2 | 11/2004 | Mazzarolo | |
| 6,852,087 | B1 * | 2/2005 | Dainese | 602/19 |
| 7,117,537 | B2 | 10/2006 | Mazzarolo | |
| 7,229,390 | B2 | 6/2007 | Fujii et al. | |
| 7,516,498 | B2 | 4/2009 | Torry | |
| 2001/0014981 | A1 | 8/2001 | Fairhurst et al. | |
| 2002/0138893 | A1 | 10/2002 | Culhane | |
| 2003/0140404 | A1 | 7/2003 | Golde | |
| 2004/0025217 | A1 | 2/2004 | Mazzarolo | |
| 2004/0255358 | A1 | 12/2004 | Ota et al. | |

FOREIGN PATENT DOCUMENTS

| | | | |
|---|---|---|---|
| DE | 37 31 878 | | 1/1989 |
| DE | 39 00 694 | A1 | 7/1990 |
| DE | 41 42 279 | A1 | 11/1992 |
| DE | 195 27 037 | A1 | 1/1997 |
| DE | 199 20 562 | | 11/2000 |
| DE | 100 17 792 | | 10/2001 |
| EP | 0 118 898 | | 9/1984 |
| EP | 0 950 360 | | 10/1999 |
| FR | 2 449 415 | | 9/1980 |
| FR | 2 476 453 | | 8/1981 |
| FR | 2 665 060 | | 1/1992 |
| GB | 171 258 | | 11/1921 |
| GB | 2 043 430 | | 10/1980 |
| WO | 01/10254 | | 2/2001 |

OTHER PUBLICATIONS

Written Opinion of corresponding PCT/EP2004/013095.
International Search Report dated Mar. 12, 2004, from corresponding International Application No. PCT/EP03/11991.
International Preliminary Examination Report dated Jan. 17, 2005, from corresponding International Application No. PCT/EP03/11991.
United States Office Action dated Mar. 2, 2006, from corresponding U.S. Appl. No. 11/116,126.
United States Office Action dated Feb. 21, 2007, from corresponding U.S. Appl. No. 11/116,126.
United States Office Action dated May 19, 2009, from corresponding U.S. Appl. No. 11/116,126.
United States Office Action dated Dec. 1, 2004, from corresponding U.S. Appl. No. 10/399,347.
United States Office Action dated May 18, 2005, from corresponding U.S. Appl. No. 10/399,347.
United States Office Action dated Feb. 22, 2006, from corresponding U.S. Appl. No. 10/399,347.
United States Office Action dated Feb. 23, 2004, from corresponding U.S. Appl. No. 10/415,624.

* cited by examiner

GARMENT FOR SPORTING ACTIVITY

This application is a National Phase Application of International Application No. PCT/EP2004/013095, filed Nov. 18, 2004, which claims the benefit under 35 U.S.C. 119 (a-e) of TV2004A000072 filed Jun. 24, 2004, which is herein incorporated by reference.

The present invention relates to a garment for sporting activity, in particular for motorcyclists.

It is usual for those who practice sporting activities, for example motorcycling, to make use of rigid protective elements in order to protect the parts of the body which are most at risk in the event of falls or violent impacts. In particular, a protective element is used for the back, said element consisting normally of a resistant shield which is applied underneath a protective garment which, for the sake of simplicity here and by way of example, is considered to be a riding suit. It is clear that despite the fact that reference is made to a motorcyclist's suit, the subject of the invention may also be used in any other category of garments, of the sporting type or not, where the particular characteristics features of the invention are required.

Normally fixing means (buckles, laces, adjustable straps, etc.) are associated with the abovementioned shield in order to ensure that it may adhere firmly and be gripped tightly against the motorcyclist's body, in order to prevent the shield from moving and thus exposing the parts which are to be protected.

This protective solution has, however, certain disadvantages. In fact, in the event of a fall, the suit may tear and uncover the motorcyclist's body, exposing him/her to wounds or abrasions. Moreover, owing to tearing of the suit, the shield and any other protective elements which are fixed to the suit may move, uncovering the back and the protected parts and exposing them to the risk of injuries.

The main object of the present invention is to improve this state of the art, i.e. provide a garment, in particular a suit, which ensures improved protection for the rider.

Another object of the invention is to increase the wearing comfort of the garment. These objects are achieved by the garment designed in accordance with the claims present at the end of this description.

The characteristic features and further advantages of the garment according to the invention will emerge more clearly from the following description of a preferred embodiment of a garment. It is understood that this description is provided solely by way of a non-limiting example, it being possible to imagine many variations which are based on the same inventive idea and which therefore all fall within the scope of protection of the invention. In the description reference will be made to the accompanying drawings, in which.

The Figures show a suit 10 which surrounds the whole of the rider's body except for the head, hands and feet Said suit 10 comprises two leg portions 12, a trunk portion 14 and two sleeves 16.

Figure 2:
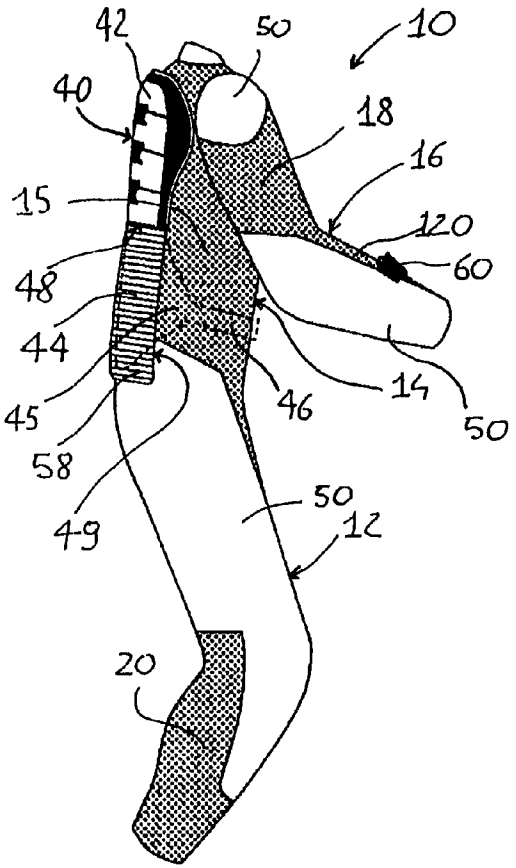
FIG. 2 shows a side view of the suit according to FIG. 1.
Figure 1:
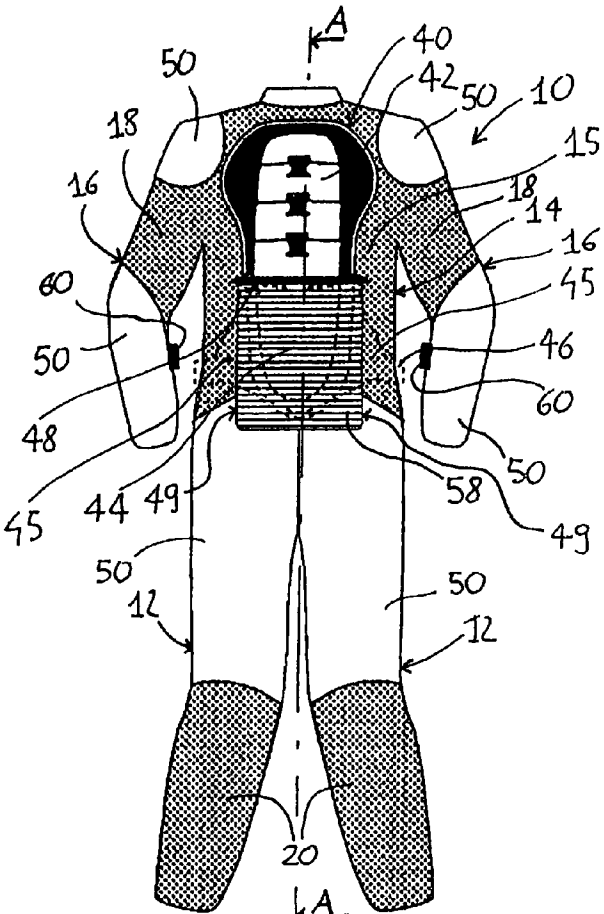
FIG. 1 shows the rear of a suit according to the invention.

Protection for the back against knocks resulting from falls or impacts is ensured by a known elongated plastic shield 40, the top end 42 of which has a widened form in order to protect the shoulder blades, while the bottom end or tail 44—shown in broken lines in FIGS. 1 and 2—protects the lumbar region with an appendage 45 and surrounds the rider's waist with a fixing belt 46. Said shield may be fixed to the fabric of the suit 10, for example by means of a zip (not shown) along its perimeter. In this way it is possible to remove the shield 40, which may be damaged after a fall, by simply opening the zip fastener and replacing the damaged shield 40 with a new one.

In FIGS. 1 and 2 the parts shown as a shaded dotted area are made of a light and breathable mesh fabric (known as "mesh"). In particular, the trunk portion 15, from which two segments 18 covering the arm and two segments 20 covering the leg extend, are made of said material.

The segments 18 which surround the arm completely extend with a strip 120 above the forearm as far as the rider's wrist, while the segments 20 surround the leg completely, except for an area on the front part of the knee.

Figure 3:
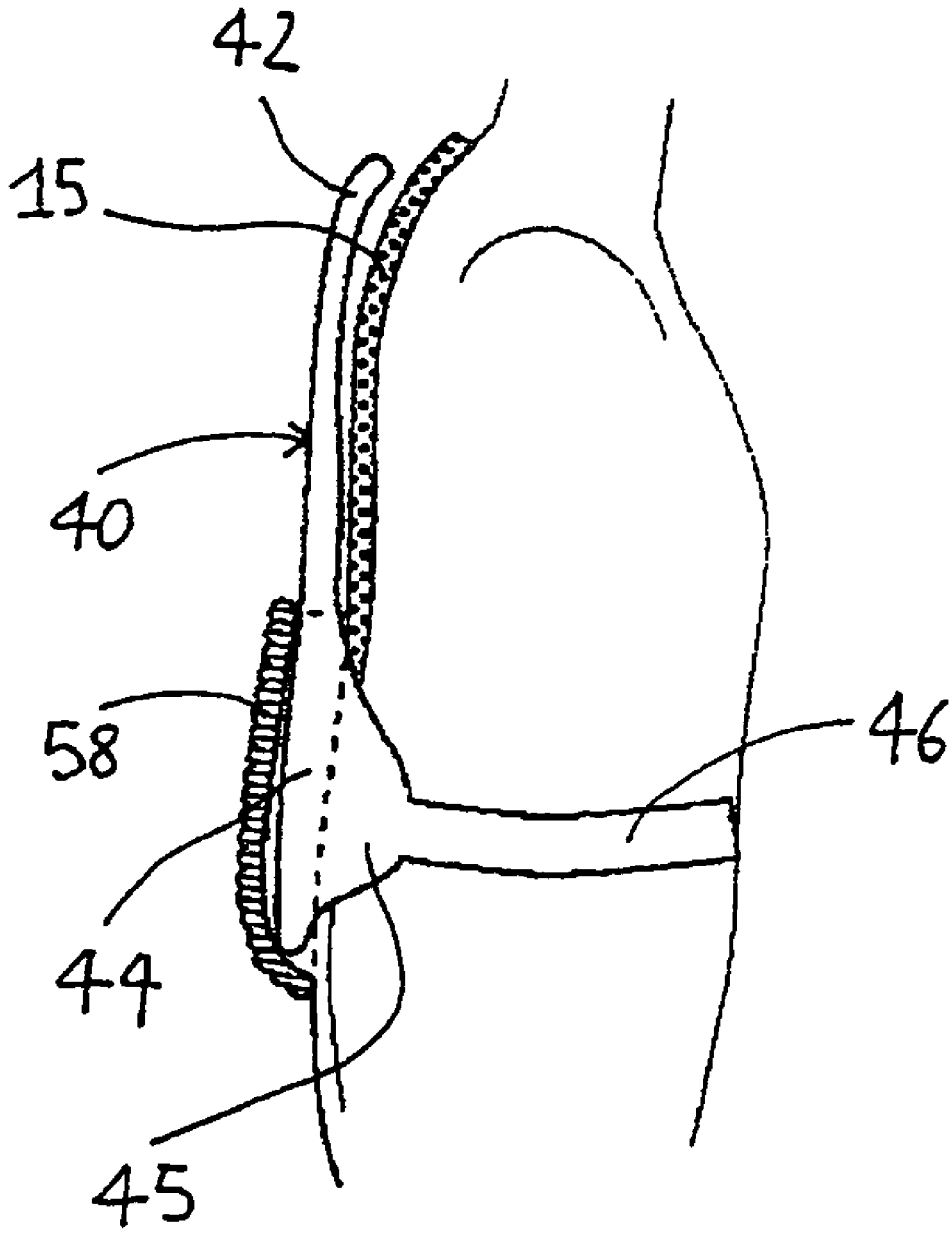
FIG. 3 shows a vertical cross-sectional view along the plane A-A of FIG. 1.

As can be seen from the Figures, in the lumbar zone of the suit 10 the "mesh" fabric is interrupted approximately along an upper unstitched edge 48 by a layer of puckered elastic material 58 fixed along its side edges 49 to the mesh fabric. Therefore the tail 44 of the shield 40 is able to be inserted underneath the puckered material 58—cf. FIG. 3—being fixed directly onto the rider's back.

With this solution it is possible to insert the lumbar appendage 45 of the shield 40 inside the suit 10, causing it to adhere perfectly to the riders waist and ensuring optimum fixing by means of the belt 46.

As an alternative it is also possible to line internally the puckered layer 58 so as to contain the shield 40, perforating the lining so that the belt 46 is able to pass through. Since what is essential is to form a slit in the suit 10 so that the tail end 44 of the shield 40 can be inserted underneath the fabric, a simple incision in the suit itself may also be sufficient.

The arrangement of the shield 40 on top of the suit 10—which is a characteristic feature of the invention—allows more effective protection of the fabric of the suit 10. In this way tearing of the said suit 10 on the back is prevented in the event of a fall, with the result that the safety of the entire garment improves overall. Moreover the use of a light and breathable material such as the "mesh", which is possible because it is protected by the shield 40, increases the comfort of the rider. In fact, the use of a breathable material for the abovementioned parts allows increased ventilation of the rider's body. In particular, the "mesh" material has produced excellent results in this connection. The fact of incorporating the shield 40 inside the suit 10 also ensures that the suit 10 adheres better to the body, improving its wearing comfort.

It should be noted that another characteristic feature as regards comfort for the rider consists of the puckered material 58, owing to the fact that it manages to stretch elastically and be deformed in accordance with the rider's posture, especially when the rider bends forwards over the motorcycle.

In the suit 10 the parts covering the shoulders, the forearms, the thighs and the front part of the knee are made of leather (or material with a high resistance both to abrasion and to knocks)—indicated by 50 in the figures—so as to offer adequate protection.

Another problem solved by the present invention is as follows. Usually rigid protective elements (not shown) are worn on the elbows, being placed inside the suit using known fixing systems. As already mentioned, the protective elements following a knock or fall may move.

The suit 10 according to the invention improves the state of the art. It has a strip of "mesh" material 120 which interrupts the leather fabric 50 around the forearms. An adjustable buckle 60 is also fixed onto the portions of said leather fabric. By varying the tension of the buckle 60 the adhesion of the leather fabric 50 in contact with the forearms is tightened or loosened until optimum fixing of the element protecting the elbow is obtained, further increasing the wearing comfort of the suit 10, since the rider is able to adapt the suit 10 to his own body build.

It should be noted that, despite the fact that "mesh" material has been used for most of the surface of the suit 10, it is also possible to imagine using a stronger material, for example leather. In this case also, the advantages of better protection resulting from positioning of the shield 40 on top of the suit are retained.

It is understood that minor variations to the idea proposed by the present invention are nevertheless included in the following claims. For example, parts of the suit other than those described may be made of breathable material.

The invention claimed is:

1. A suit for a sporting activity, in particular for motorcyclists, comprising: parts made of a breathable fabric, the suit covering a trunk, forearms, and legs of a user, a shield is located in a lumbar zone of the suit and is inserted underneath a layer of puckered elastic material, the layer of elastic material is fixed along its side edges to the suit's breathable fabric, disposed in the trunk portion of the suit wherein the shield has a widened top end situated near a shoulder area of the suit to protect the shoulder blades, a lower appendage covering a middle back portion of the suit and a fixing belt extending laterally from each side of the shield and thereby surrounding the user's waist.

2. Suit according to claim 1, wherein said breathable fabric is a mesh fabric.

3. Suit according to claim 1, wherein said appendage of the shield is inserted underneath the layer of puckered elastic material.

4. Suit according to claim 1, wherein the shield is fixed by means of a zip so as to be removable.

5. Suit according to claim 1, wherein the parts covering shoulders and thighs and a knee and forearms of the user are made of material resistant to abrasion.

6. Suit according to claim 5, wherein said material resistant to abrasion is leather.

7. Suit according to claim 5, wherein a strip of breathable fabric interrupts said material resistant to abrasion around the forearms and an adjustable buckle is fixed to the portions of said material.

8. Suit according to claim 1, wherein the parts covering shoulders and thighs and a knee and forearms of the user are made of material resistant to knocks.

9. Suit according to claim 8, wherein said material resistant to knocks is leather.

10. Suit according to claim 8, wherein a strip of breathable fabric interrupts said material resistant to knocks around the forearms and an adjustable buckle is fixed to the portions of said material.

11. Suit according to claim 1, wherein the shield is joined externally to cover a back of the user, and a tail end of the shield in the lumbar zone of the suit is inserted underneath the layer of puckered elastic material.

* * * * *